US005570559A

United States Patent [19]

Lewis

[11] Patent Number: 5,570,559

[45] Date of Patent: Nov. 5, 1996

[54] FALL ARRESTOR

[76] Inventor: Thomas D. Lewis, P.O. Box 345, Cleveland, S.C. 29635

[21] Appl. No.: 533,929

[22] Filed: Sep. 26, 1995

[51] Int. Cl.[6] ..... E04G 3/00

[52] U.S. Cl. ..... 52/749.2; 52/741.3; 52/DIG. 12; 182/45; 182/113; 248/237; 256/DIG. 6

[58] Field of Search ..... 52/127.2, DIG. 12, 52/741.3, 749.12, 27; 182/45, 59, 60, 113; 248/237; 256/1, 65, DIG. 6

[56] References Cited

U.S. PATENT DOCUMENTS

| | | | |
|---|---|---|---|
| 2,295,995 | 9/1942 | Lamb | 182/113 X |
| 2,329,415 | 9/1943 | Osborne | 182/45 X |
| 3,595,510 | 7/1971 | Hutchinson | 182/113 X |
| 3,901,481 | 8/1975 | Probst . | |
| 4,957,185 | 9/1990 | Courchesne et al. | 182/45 X |
| 4,979,725 | 12/1990 | Hutchings, II . | |
| 4,989,689 | 2/1991 | Berlin . | |
| 5,067,586 | 11/1991 | Myers . | |

FOREIGN PATENT DOCUMENTS

| | | | |
|---|---|---|---|
| 2504348 | 8/1976 | Germany . | |
| 3132193 | 5/1983 | Germany . | |
| 3719403 | 12/1987 | Germany | 182/45 |
| 8800-985 | 1/1989 | Netherlands . | |
| 0919971 | 2/1963 | United Kingdom | 182/45 |
| 2243397 | 10/1991 | United Kingdom . | |

*Primary Examiner*—Robert Canfield
*Attorney, Agent, or Firm*—Leatherwood Walker Todd & Mann, P.C.

[57] ABSTRACT

A fall arrestor device for use in connection with a building having a roof under construction. The device includes a bracket for attaching to a top plate of a vertical wall, adjacent the edge of the roof. Extending downwardly from the bracket is a leg which hangs substantially parallel to the wall. Extending upwardly from the leg is a support arm having a receptacle on a free end thereof for receipt of the upright portion of a guard rail. A bracket member extends between the leg and the support arm, and the connection of the bracket member to the support arm, and the support arm to the leg, are variable such that the receptacle presents the guard rail vertically with respect to a variety of different pitched roofs and roofs of a variety of different width overhang portions.

15 Claims, 5 Drawing Sheets

28
118
102
100
28
104
48
44
40
46
42
30
52
26
36
34
38
106
79
98
94
96
76
108
74
31
50
66
72
82
84
60
80
90
64
110
54
56
24'

28'
118'
26'
30
40
52
34'
76'
74'
80
50
86
60
62
24"
70
110'

FALL ARRESTOR

BACKGROUND OF THE INVENTION

This invention relates generally to a system for arresting the fall of roofing personnel.

In working on elevated surfaces, the dangers of a disabling or fatal fall are always present for workers, unless some reliable restraint system is provided for the elevated surface to protect the workers from a fall. Persons working on roofs of buildings and homes are especially vulnerable to these falls since oftentimes fall arrest systems are not used by the workers. Such systems are not used for a variety of reasons. For example, one such system requires the worker to wear a belt and have a restraint rope connected to the belt. The other end of the rope is connected to some portion of the building such that should the worker slip and fall, the rope prevents the worker from falling to the ground. Workers are sometimes reluctant to use these systems because they are cumbersome and impede free movement about the roof.

Another type of system also includes a belt or harness worn by the user, with the harness connected to a rope or belt, which is in turn connected to an inertia-reel type system. In this type of system, the inertia-reel allows payout of the rope as the worker moves about the roof, but should the worker move suddenly or jerk the rope, the inertia-reel locks and prevents further payout of the rope, similar to how inertia-reel automotive safety belts operate. The purpose of the abut system is to sense when a worker begins to free fall and to thereby lock the belt to prevent the user from hitting the ground. This can be annoying to workers in that should they inadvertently make a sudden move, the rope becomes locked. Fall protection systems are particularly important to provide for worker safety and for limiting liability, but such systems are of increasing importance due to recent OSHA regulations requiring fall arrest systems for certain workers working above ground or floor level in certain situations.

Various fall arrest systems have been patented. For example, Netherlands patent document 8800-985 discloses a fall arrest system which connects to a roofing gutter and which bears against the side wall of the building. Such an application would generally not be acceptable where gutter systems are of the type typically constructed in the United States. U.S. Pat. No. 5,067,587, issued to Myers, discloses a safety guard apparatus which actually attaches to a roof being constructed, and which apparently must be removed in order to complete the roof. British Patent Application No. 2,243,397, discloses a safety guard rail apparatus having a plurality of members which also attaches to the roof and which also must apparently be removed before the roof can be completed. German Patent Document No. 2504348 and U.S. Pat. No. 3,901,481, issued to Probst, disclose safety rail systems which attach to the roof. German Patent Document No. 3132193 discloses a fall arrest system for use especially on flat roofs having a retaining plate for anchoring in the roof's surface. The device of U.S. Pat. No. 4,979,725, issued to Hutchings II, et al., is also fixedly attached to the roofing or wall structure, and U.S. Pat. No. 4,989,689, issued to Berlin, discloses a device for attachment to the edges of a roof being re-shingled which prevents the old shingles from falling onto shrubbery and into the yard.

Taking into account the above restraint devices, there still exists a need for a device contemplated by the present invention which can be easily connected to and removed from a building, particularly during initial construction of a roof. Such a device would overcome limitations of the above devices in that it would be readily attachable to the structure in a manner which would not significantly interfere with complete construction of the roof. Such a device would also be readily adjustable to accommodate structures having differing wall thicknesses and roofs of different pitches. Further, such a device would be easy to set up, take down, and transport from one job site to another. Another desired feature would be that the device would include a walkboard or a platform which could be used by workers when working at the extremities of the roof.

Moreover, the device would ideally be able to accommodate roofs having overhang portions of a variety of dimensions.

SUMMARY OF THE INVENTION

It is, therefore, the principal object of this invention to provide a portable fall arrestor system which can readily be attached to and removed from a structure having a roof under construction.

Another object of the present invention is to provide a fall arrest device which can be used for roofs of a variety of pitches.

Another object of the present invention is to provide a fall arrest device which can be used on roofs having eaves of a variety of dimensions.

It is another object of the present invention to provide a fall arrest device which attaches to a wall of a building instead of the roof surface, such that the roof can be substantially completed while such fall arrest device is in place.

Still another object of the present invention is to provide a fall arrest device which provides a substantially horizontal platform extending outwardly from the edge of the roof for use as a walkboard or storage area.

Yet another object of the present invention is to provide a method of using a fall arrestor device constructed in accordance with the present invention.

It is still further, another object of the present invention is to provide a fall arrest device having guard rails which can be readily constructed of ordinary materials typically found at a construction site.

Generally, the present invention includes a guard rail support device for attachment to a wall of a building, the wall having an upper portion with a substantially horizontal portion, and a lower portion. The device comprises a bracket for attachment to the upper wall portion and an elongated member having an upper end connected to the bracket and a lower end for exerting pressure on the lower wall portion. A support arm is provided having a first end connected to the lower end of the elongated member and extending upwardly therefrom. The support arm has a second end and a guard rail receptacle connected to the second end. A brace having a first end connected to the elongated member, between the upper and lower ends of the elongated member, is provided, and the brace has a second portion connected to the support arm between the first and second ends of the support arm. The support arm supports the guard rail receptacle such that upon placement of the guard rail in the guard rail receptacle, the guard rail extends substantially vertically upwardly from the guard rail receptacle.

The bracket is designed to typically engage the substantially horizontal portion of the upper wall, often known as the cap or top plate of the wall. The elongated member may include a foot extending outwardly from the lowest portion thereof to contact and to exert a resultant force on the wall.

The method for supporting a guard rail from the wall includes attaching the bracket to the upper wall such that the elongated member extends downwardly therefrom. The support arm is connected to the lower end of the elongated member such that the receptacle presents a vertically disposed receiver. The brace member is connected between the elongated member and the support arm such the receiver becomes fixed in a substantially vertical disposition. The guard rail is then inserted in the receiver to provide for a fall arresting structure.

BRIEF DESCRIPTION OF THE DRAWINGS

The foregoing, as well as other objects of the present invention, will be further apparent from the following detailed description of the preferred embodiment of the invention, when taken together with the accompanying specifications and the drawings, in which.

DESCRIPTION OF THE PREFERRED EMBODIMENT

Figure 1:
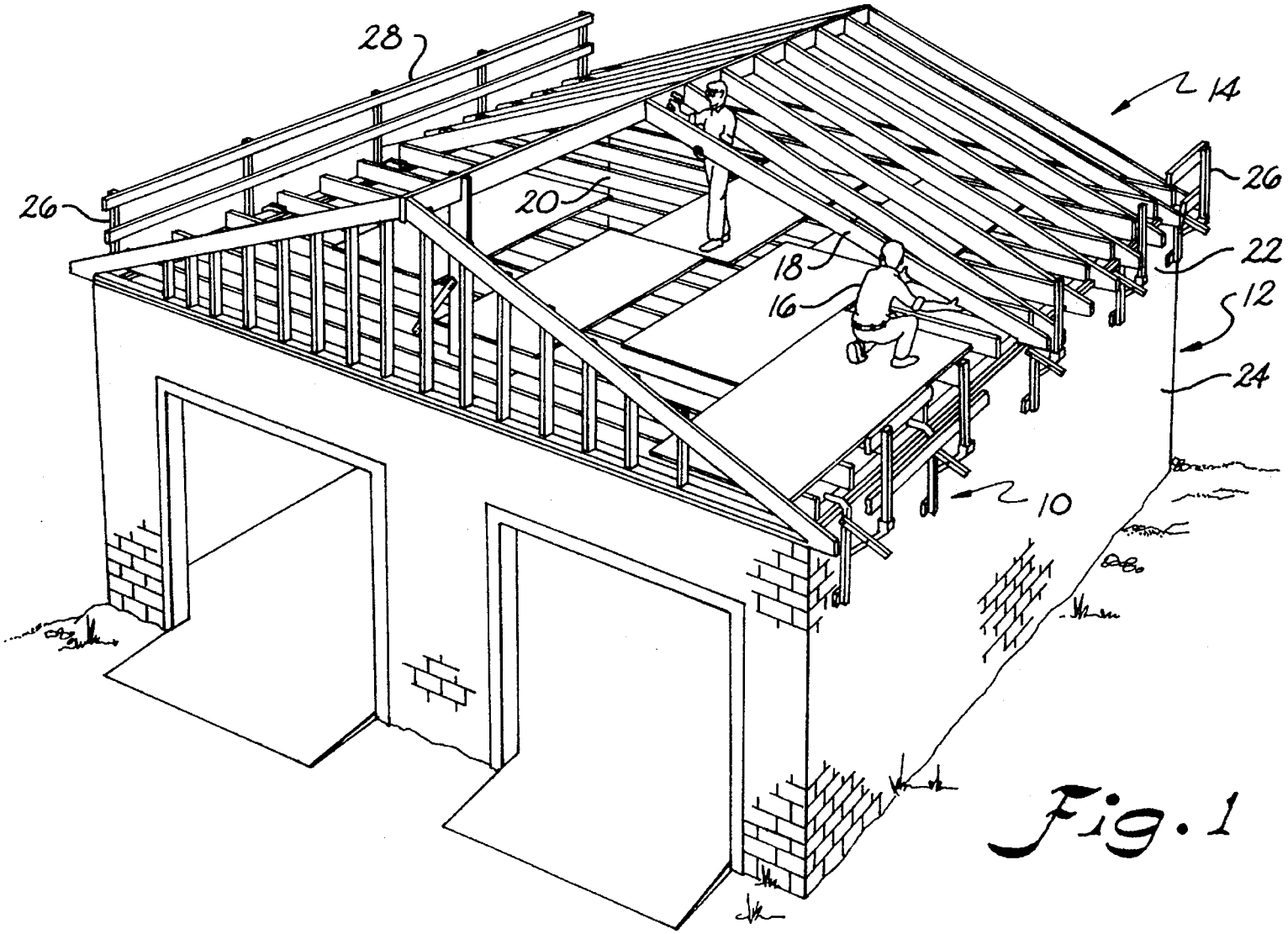
FIG.1 a perspective view of a building having a roof under construction with an installed fall arrest system constructed in accordance with the present invention.

The accompanying drawings and the description which follows set forth this invention in its preferred embodiment. However, it is contemplated that persons generally familiar with restraint systems will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like or similar elements or features throughout the various views, the fall arrest device of the present invention is indicated generally in the figures by reference character 10.

Turning now to FIG. 1, the fall arrestor 10 of the present invention is illustrated in use with the construction of a building 12. As illustrated in FIG. 1, the roof, generally 14, is shown under construction with workers 16 installing the supports 18 for what will become the base surface of the roof. While the workers shown in FIG. 1 are walking on the horizontal rafter 20 portion of the roof being constructed, it is to be understood that once the roof supports 18 are completed, sheathing (not shown) is typically applied to the roof supports 18 onto which a roofing material, such as shingles, tin, steel, or other roofing materials are applied, although in some instances it may only necessary to provide for cross members on the roof supports instead of the sheeting. In any event, the workers will subsequently be required to work on the sloped roof's exterior which will obviously present the potential for slipping and falling from the roof. Hence, the need for applicant's fall arrest system 10. Although the risk of a worker falling is greatly increased when working on the sloped portion of the roof, there is still the danger of a worker falling even when the workers are working on the rafter portions 20 of the roof, as illustrated in FIG. 1.

From FIG. 1 it is also illustrated that there are preferably a plurality of fall arrestor devices 10 provided along the entire length of the upper walls 22 adjacent the roof. At a minimum, however, the fall arrest devices 10 should be placed adjacent a particular work area of the roof, if such are not provided along the entire length of the walls 24. Inserted in the fall arrest devices 10 are a series of uprights 26 to which longitudinally extending rails 28 are connected, which provide actual barriers for preventing a worker from tumbling off the edge of the roof.

Figure 2:
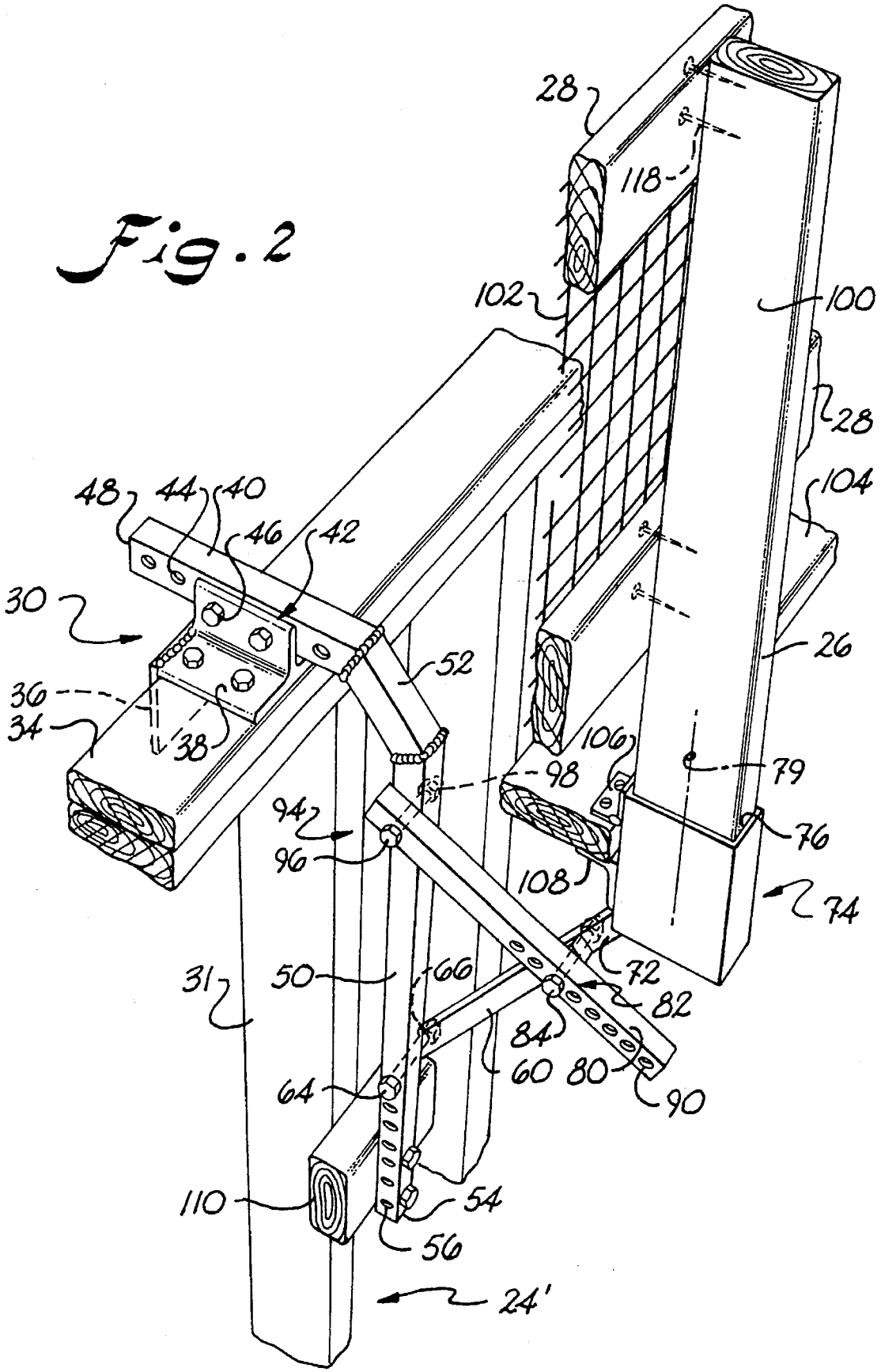
FIG.2 a perspective view, with parts cut away, of a fall arrest device constructed in accordance with the present invention and attached to a framed wall.
Figure 3:
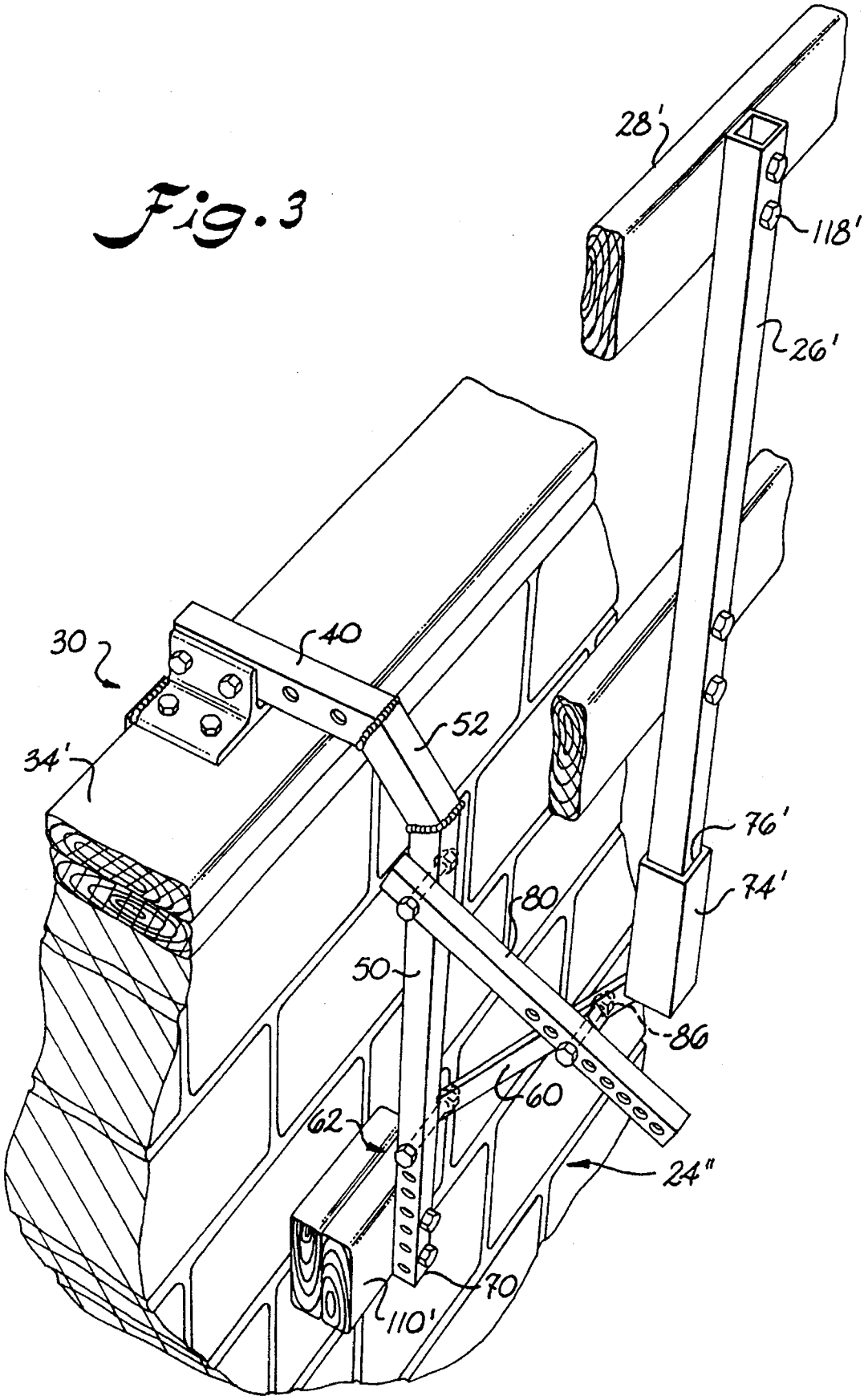
FIG. 3 a fall arrest device constructed in accordance with the present invention attached to a brick wall.

FIGS. 2 through 5 illustrate fall arrestor 10 in detail. Starting from the uppermost portion of fall arrestor 10, a bracket, generally 30, is provided for attachment to an upper wall portion 22 of a wall 24'. As illustrated in FIG. 2, the wall 24' is the basic framed wall, having studs 31, prior to insulation, exterior sheathing, or interior coverings being applied. It is to be understood that the present invention can be used on a wall support as basic as that illustrated in FIG. 2, and also for a fully completed exterior wall 24" such as illustrated in FIG. 3, which shows the wall 24" constructed of brick or brick veneer.

The bracket 30 typically engages the cap or top plate 34 which extends horizontally along the upper edge of the wall 24'. The bracket 30 is preferably an L-shaped member having an engagement member 36 and a generally horizontally positioned member 38 which connects to a support rail 40 extending generally above and across and substantially perpendicularly to the top plate 34. Bracket 30 is adjustable with respect to support rail 40 such that walls of differing thicknesses may be accommodated by fall arrestor 10. Adjustment means, generally 42, for adjusting bracket 30 with respect to support rail 40 can be of a variety of configurations, and one such configuration is illustrated in the figures as a plurality of holes 44 being provided in support rail 40, and bracket 38 including bolts 46 which may be inserted into the openings 44 in a manner to vary the distance between engagement member 38 and the free end 48 of support rail 40. Bolts 49 may also be provided, if desired, for attaching bracket 30 to top plate 34.

Extending downwardly from and substantially perpendicularly to support rail 40 is an elongated support member, or leg, generally 50, which is fixedly connected to support rail 40. It has been found that an angled portion 52 is preferably provided between support rail 40 and leg 50 in order to aid in removal of fall arrestor 10 from a wall, particularly after installation of the roof sheathing. The free end 54 of leg 50 is provided with a plurality of openings 56, the purpose of which will be described later.

Connected to the lower end of leg 50 is a support arm 60. A pivotal connection 62, such as a bolt 64 and nut 66, allows support arm 60 to selectively pivot with respect to leg 50. Openings 56 in the lower end of leg 50 allow for end 70 of support arm 60 to be connected in a variety of positions with respect to leg 50. The other end 72 of support arm 60 is provided with a generally box-shaped receptacle, generally 74, with a generally rectangularly-shaped open chamber, or receiver, generally 76. Receptacle 74 is fixedly connected to support arm 60 by means of welding, bolts (not shown), or the like. Receiver 76 includes a central axis 79 which preferably extends vertically. The central axis 79 of the receiver is preferably at an angle greater than 90 degrees with respect to support arm 60.

In between ends 70, 72 of support arm 60, a brace 80 is pivotally connected through use of a pivotal connector 82 such as a bolt 84 and nut 86. Brace 80 includes in one end a plurality of holes 90 for allowing brace 80 to be connected to support arm 60 at a variety of positions. The other end of brace 80 is also provided with a pivotal connector 94, such as a bolt 96 and nut 98, for attaching that end of brace 80 to an upper portion of leg 50.

As shown in FIG. 2, a piece of wood of standard size, such as a length of 2×4 lumber 100 is preferably inserted into receiver 76 of receptacle 74. The thus-formed upright 26 provides support and an attachment surface for horizontally extending guard rails 28, which may also be constructed of ordinary lumber, such as lengths of 2×4 wood. Attachment of the rails 28 to uprights 26 can be done with screws, nails, or the like. As illustrated in FIG. 1, a number of fall arrestors 10 are typically provided on a building, and likewise, a number of uprights 26 and corresponding guard rails 28 are also provided. Because commonly available lumber may be used to construct the uprights and guard rails, the fall arrestors 10 themselves are relatively small and easily transportable from job site to job site, with the uprights and guard rails being constructable at the onset of a project. The uprights and guard rails may be disassembled at the end of a project and used as construction material for the project or used again as uprights and guard rails on a later job. It is to be understood, however, that uprights and guard rails can be constructed of metal, plastic, or any other suitable material, if desired.

The fall arrestor device is preferably constructed of channel or tubing bent or welded as necessary. However, other conventional materials and construction techniques could be used. Additionally, although receptacle 74 is illustrated as being box-shaped, it is to be understood variations could be made in the shape of receptacle 74 without departing from the teaching of the fall arrestor disclosed herein.

Turning again to FIG. 2, several additional features of the fall arrest system are to be noted. First, webbing, screen, or other sheet material, generally 102, can be connected between guard rails 28 to provide further protection from falls of workers and tools or materials which may be dropped. Instead of webbing 102, rigid panels (not shown), could also be provided to span between rails 28. A walkboard, generally 104, could further be provided on fall arrestor 10, and could be connected to receptacle 74 or upright 26, in a hinged fashion by means a hinge, generally 106, which would support walkboard 104 in a horizontal configuration as shown in FIG. 2. The walkboard 104 thus could be pivoted upwardly to stand up substantially parallel with respect to uprights 26, or could be pivoted downwardly and restrained in a horizontal position with such hinge or other support, such as an L-shaped bracket 108 attached to receptacle 74, to thereby provide a walking surface for workers and/or a storage surface for tools and materials (not shown). Walkboard 104 would also provide additional security against a worker falling from the roof between the edge of the roof and uprights 26 and rails 28.

To provide spacing between the lower end of leg 50 and wall 24, a piece, or pieces, of 2×4 lumber or other materials could be used for providing a block 110 to allow proper spacing of the end of leg 50 such that leg 50 hangs substantially vertically with respect to the wall 24. Block 110 may be attached to leg 50 or the wall 24 by bolts or screws 115, if desired. As illustrated generally in FIG. 5, instead of requiring additional material for spacing the lower portion of leg 50 from the wall, a foot 112 can be provided with leg 50 which is adjustable with respect to the end of leg 50 by means of holes 56, 114 provided in leg 50 and foot 112, respectively, and through use of a pivotable connector 116 which would allow selective adjustment of the end of leg 50. The lower end of leg 50 transfers lateral forces, or pressure, to the wall developed by the weight of arrestor 10, whereas bracket 30 applies combined lateral and downward forces, or pressures, on the upper wall portion, i.e., bracket 30 places substantially the entire vertical load of device 10 on the upper wall.

FIG. 3 illustrates the fall arrestor being connected to a finished exterior wall surface 24". It also illustrates bracket 30 being moved to the outermost portion of support rail 40 to accommodate a thicker wall. FIG. 3 also illustrates a receptacle 74' having a receiver 76' which is designed to receive a more permanent upright 26' which would be constructed of metal tubing and which could be transported from job to job along with the fall arrestor. Guard rails, such as 2×4s or other metal or woods rails are attached to upright 26' through bolts or screws 118' or brackets (not shown).

Figure 4:
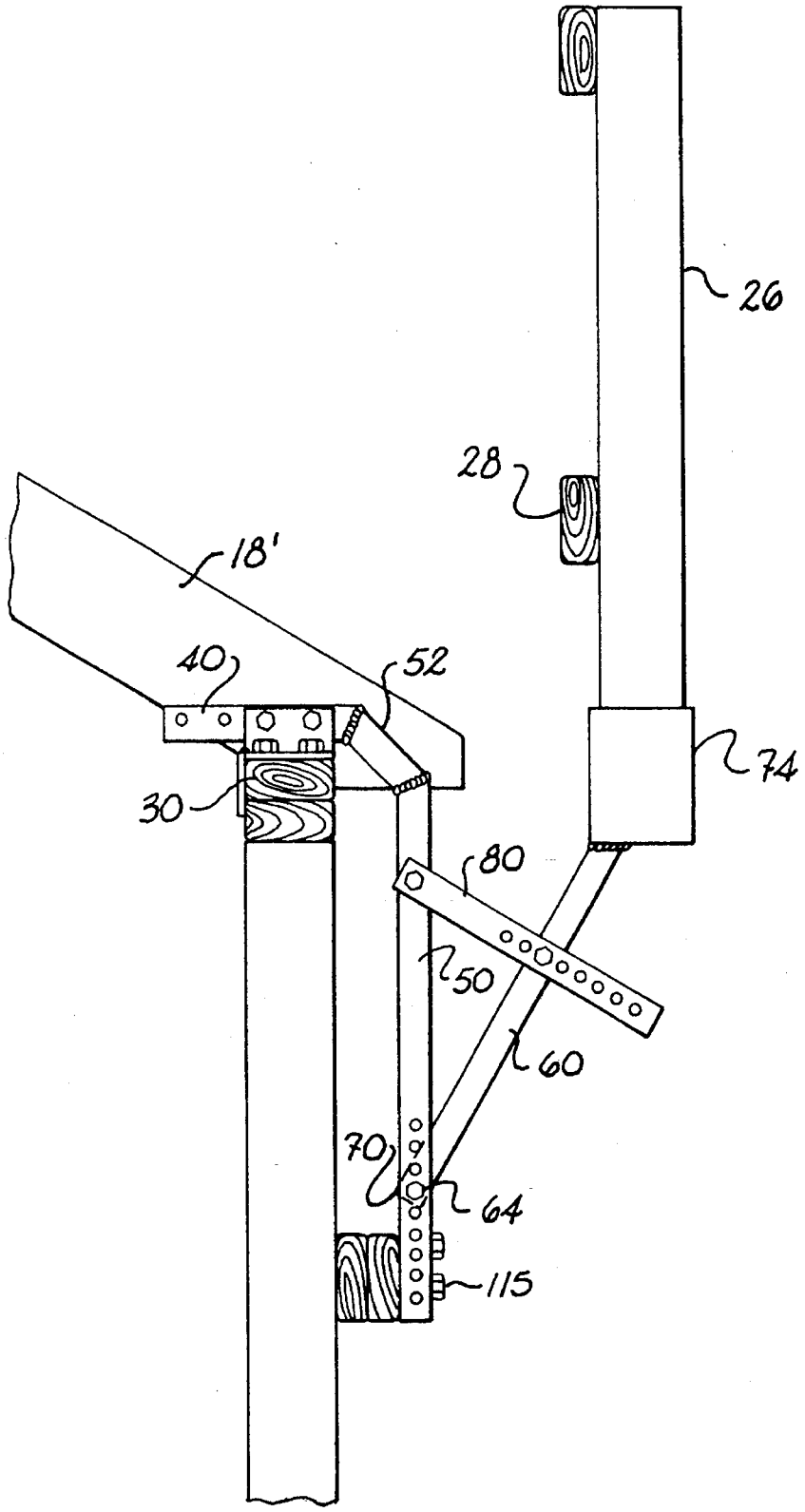
FIG. 4 a side elevational view of a fall arrest device constructed in accordance with the present invention for use with a roof having a moderate pitch.

A primary object of providing the fall restraint system 10 is to present the guard rails 28 in a substantially vertical relationship with respect to the roof, or in other words, to present guard rails 28 in a configuration which is substantially parallel to the wall. In performing the method to provide this, the appropriate hole 56 in leg 50 is selected such that support arm 60 presents receptacle 74 in a vertical position such that the central axis 79 of receiver 76 is also vertical for likewise support of the upright in a vertical configuration. Once this has been determined, the appropriate hole 90 in brace 80 is selected and the bolt 96 is placed through the corresponding hole 68 and support arm 60. As shown in FIG. 4, which illustrates a roof having supports 18' of moderate slope, the receptacle 74 is fixed in a vertical disposition, and therefore the upright 26 is in a vertical position.

Figure 5:
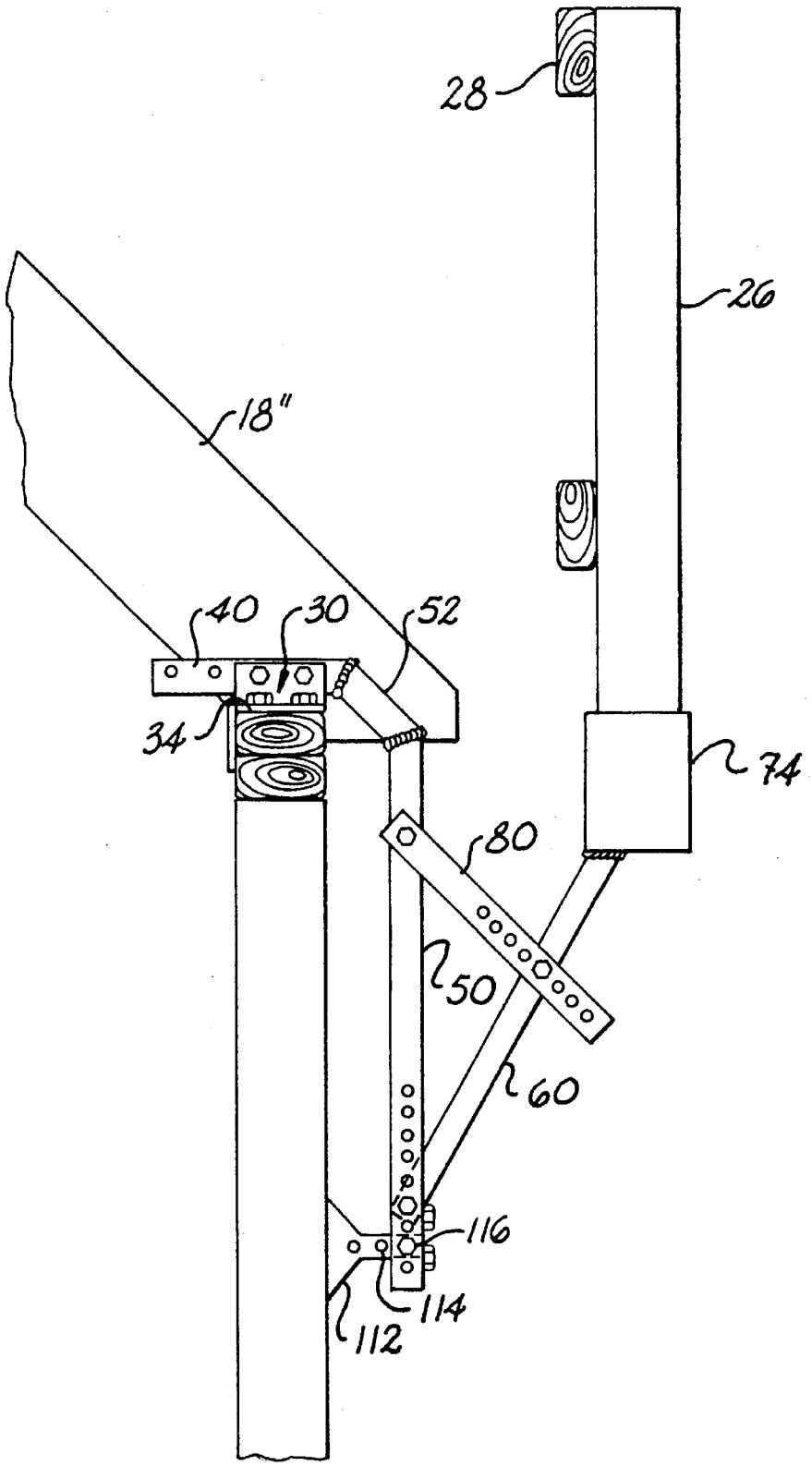
FIG. 5 a side elevational view of a fall arrest device constructed in accordance with the present invention for use with a roof having a steeper pitch than the roof illustrated in FIG. 4.

FIG. 5 illustrates the same concept with a roof having supports 18" of a much steeper slope. By selection of differing holes on both the leg 50 and brace 30 to which support arm 60 will be connected, receptacle 74 is still presented in a vertical fashion with respect to the edge of the roof. It is to be further recognized that the clearance between the edge of the roof and the receptacle can be varied by selecting desired holes 56, 90 of leg 50 and brace 80, respectively. This allows fall arrestor 10 to be used with roofs of varying overhang, or eave, dimensions.

From the foregoing, it can now be understood how the fall arrestor of the present invention provides a device which is portable and can be readily attached to and removed from a wall structure. Because the device attaches to the top of a wall adjacent the roof, and not to the roof itself, the device does not significantly impede full construction of the roof, including the edge portions of the roof. Additionally, the device can be readily used on roofs of differing pitch and of differing overhang dimensions. Further, the device provides a platform for use by workers or for support of tools and materials, if desired. By allowing the uprights and guard rails to be constructed on-site out of typical building materials, the device lends flexibility to sizing and dimensional variations from one job to another such that guard rails can readily be provided with standard size lumber.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A guard rail support device for attachment to a wall of a building for supporting a guard rail having an upright member, the wall having an upper wall portion with a substantially horizontal portion, the device comprising:

a bracket for attachment to the horizontal portion of the upper wall portion;

an elongated member having an upper end connected to said bracket and a lower end below said upper end;

a support arm having a first end connected to said lower end of said elongated member and extending upwardly therefrom, said support arm having a second end and a receptacle connected to said second end of said support arm for receiving an upright member of a guard rail; and a brace connected to said elongated member between said upper and lower ends of said elongated member and to said support arm between said first and second ends of said support arm, such that upon receipt of the upright in said receptacle, the upright extends substantially vertically upwardly from said guard rail receptacle.

2. A guard rail support device as defined in claim 1, further comprising said bracket including an engagement plate and a support rail, said support rail being connected to said elongated member and said engagement plate having a connector for fixing said engagement plate at a plurality of positions with respect to said support rail.

3. A guard rail support device as defined in claim 1, wherein said engagement member is adapted for engaging a substantially vertical portion of the upper wall portion.

4. A guard rail support device as defined in claim 1, further comprising said support arm having means for fixing said support arm at a plurality of positions with respect to said elongated member.

5. A guard rail support device as defined in claim 1, further comprising said elongated member including a foot extending outwardly from said elongated member for contacting the wall.

6. A guard rail support device as defined in claim 1, further comprising a pivotal connector connected to said support arm for pivotally connecting said support arm to said elongated member.

7. A guard rail support device as defined in claim 1, further comprising said brace having a connector for fixing said brace at a plurality of positions with respect to said support arm.

8. A guard rail support device as defined in claim 1, further comprising a pivotal connector connected to said brace for pivotally connecting said brace to said elongated member.

9. A guard rail support device for attachment to a wall of a building for supporting a guard rail having an upright member, the wall having an upper wall portion with a substantially horizontal portion, the device comprising:

attachment means for attachment to the substantially horizontal portion of upper wall portion;

elongated support means connected to said attachment means and extending downwardly from said attachment means;

support arm means connected to said elongated support means and extending upwardly from said elongated support means, said support arm means defining a receptacle for receiving an upright of the guard rail;

bracing means connected to both said elongated support means and said support arm means;

said attachment means adapted to place substantially the entire vertical load of the guard rail support device on the upper wall; and said support arm means being connectable to said elongated support means at a plurality of positions, and said bracing means being connectable to said support arm means at a plurality of different positions, such that said receptacle may receive the guard rail and support the guard rail in a plane substantially parallel to the wall.

10. A method for supporting an upright of a guard rail from a wall of a building, the wall having an upper wall portion with a substantially horizontal portion, the method comprising:

providing a bracket for attachment to the upper all portion and attaching the bracket to the upper wall portion;

providing an elongated member having an upper a lower end and connecting said upper end of said elongated member to said bracket such that said elongated member extends downwardly from said bracket;

providing a support arm having a first and a second end and connecting said support arm first end to said elongated member lower end;

providing a receptacle on said support arm and positioning said support arm second end such that said receptacle presents a vertically disposed receiver;

providing a brace member and connecting said brace member between said upper and lower ends of said elongated member and said support arm between said first and second ends of such that said receiver remains substantially vertical; and inserting the upright of the guard rail in said receiver of said receptacle.

11. A roof restraint device for attachment to a wall of a building, the wall having an upper wall portion with a substantially horizontal portion, the device comprising:

a bracket for attachment to the upper wall portion;

an elongated member having an upper end connected to said bracket and a lower end;

a support arm having a first end connected to said lower end of said elongated member and extending upwardly therefrom, said support arm having a second end and a guard rail receptacle connected to said second end of said support arm;

a brace connected to said elongated member between said upper and lower ends of said elongated member, and connected to said support arm between said first and second ends of said support arm; and a barrier member connected to said receptacle, and said receptacle being positioned such that said barrier member extends substantially vertically upwardly from said receptacle.

12. A roof restraint device as defined in claim 11, further comprising said barrier member including a substantially vertically extending post for receipt by said receptacle and at least one rail connected to said post, said rail extending substantially perpendicularly to said post.

13. A roof restraint device as defined in claim 11, further comprising said barrier member including webbing attached to and extending substantially vertically with respect to said barrier member.

14. A roof restraint device as defined in claim 11, further comprising a platform connected to said receptacle and extending substantially perpendicularly to said barrier member.

15. A roof restraint device as defined in claim 14, further comprising a pivotal connector connecting said platform to said receptacle for allowing said platform to pivot between a substantially horizontal position and a substantially vertical position.

* * * * *

UNITED STATES PATENT AND TRADEMARK OFFICE

CERTIFICATE OF CORRECTION

PATENT NO. : 5,570,559

DATED : NOVEMBER 5, 1996

INVENTOR(S) : THOMAS D. LEWIS

It is certified that error appears in the above-indentified patent and that said Letters Patent is hereby corrected as shown below:

In Column 3, line 18, change "specifications" to --specification--.
In Column 8, line 9, delete the word "all" and insert the word --wall--.
In Column 8, line 11, insert the word --and-- after the word "upper."

In Column 8, line 19, insert the words --second end-- after the word "arm."
In Column 8, line 24, delete "said support arm."
In Column 8, line 25, insert --said support arm--after "of."

Signed and Sealed this

Eighth Day of July, 1997

Bruce Lehman

*Attest:*

BRUCE LEHMAN

*Attesting Officer*

*Commissioner of Patents and Trademarks*